US007250193B2

(12) United States Patent
Matsukawa et al.

(10) Patent No.: US 7,250,193 B2
(45) Date of Patent: Jul. 31, 2007

(54) PRETREATMENT METHOD FOR COATING

(75) Inventors: Masahiko Matsukawa, Nishitokyo (JP); Kazuhiro Makino, Yokohama (JP); Toshiaki Shimakura, Ichikawa (JP)

(73) Assignee: Nippon Paint Co., Ltd, Osaka (JP)

( * ) Notice: Subject to any disclaimer, the term of this patent is extended or adjusted under 35 U.S.C. 154(b) by 23 days.

(21) Appl. No.: 10/743,390

(22) Filed: Dec. 23, 2003

(65) Prior Publication Data

US 2004/0144451 A1 Jul. 29, 2004

(30) Foreign Application Priority Data

Dec. 24, 2002 (JP) ..... 2002-372767
Dec. 2, 2003 (JP) ..... 2003-403690

(51) Int. Cl.
*B05D 7/16* (2006.01)

(52) U.S. Cl. ..... 427/388.1; 427/409

(58) Field of Classification Search ..... None
See application file for complete search history.

(56) References Cited

U.S. PATENT DOCUMENTS

| | | | | |
|---|---|---|---|---|
| 4,039,353 A | | 8/1977 | Kulick et al. | |
| 4,338,140 A | * | 7/1982 | Reghi | 148/247 |
| 5,380,374 A | * | 1/1995 | Tomlinson | 148/247 |
| 5,397,390 A | * | 3/1995 | Gorecki | 106/287.11 |
| 5,427,632 A | * | 6/1995 | Dolan | 148/259 |
| 5,470,613 A | * | 11/1995 | Rodzewich | 427/388.1 |
| 5,531,820 A | * | 7/1996 | Gorecki | 106/287.11 |
| 5,759,244 A | | 6/1998 | Tomlinson | |
| 6,312,812 B1 | * | 11/2001 | Hauser et al. | 428/412 |
| 6,482,274 B2 | * | 11/2002 | Shimakura et al. | 148/247 |

FOREIGN PATENT DOCUMENTS

| | | | |
|---|---|---|---|
| GB | 1076678 A | | 7/1967 |
| GB | 1520026 A | | 8/1978 |
| JP | 7-310189 | | 11/1995 |
| JP | 10-204649 | | 8/1998 |
| JP | 2004-218071 | * | 8/2004 |
| WO | WO 99/14399 | * | 3/1999 |
| WO | WO 01/86016 | * | 11/2001 |

OTHER PUBLICATIONS

Patent Abstracts of Japan, vol. 2002, No. 9, Sep. 4, 2002, Publication No. 2002146553, Publication Date May 22, 2002.

* cited by examiner

*Primary Examiner*—Erma Cameron
(74) *Attorney, Agent, or Firm*—Connolly Bove Lodge & Hutz LLP

(57) ABSTRACT

It is an object of the present invention to provide a pretreatment method for coating, which places a less burden on the environment and can apply good chemical conversion treatment to all metals such as iron, zinc and aluminum.

A pretreatment method for coating comprising treating a substance to be treated with a chemical conversion coating agent to form a chemical conversion coat, wherein the chemical conversion coating agent comprises at least one kind selected from the group consisting of zirconium, titanium and hafnium and fluorine, the chemical conversion coat has a fluorine concentration of 10% or less on the atom ratio basis, and at least a part of the substance to be treated is an iron material.

8 Claims, No Drawings

PRETREATMENT METHOD FOR COATING

TECHNICAL FIELD

The present invention relates to a pretreatment method for coating.

BACKGROUND ART

When a cationic electrocoating or a powder coating is applied to the surface of a metal material, a chemical conversion treatment is generally applied in order to improve the properties such as corrosion resistance and adhesion to a coating film. With respect to a chromate treatment used in the chemical conversion treatment, from the viewpoint of being able to further improve the adhesion to a coating film and the corrosion resistance, in recent years, a harmful effect of chromium has been pointed and the development of a chemical conversion coating agent containing no chromium is required. As such a chemical conversion treatment, a treatment using zincphosphate is widely adopted (cf. Japanese Kokai Publication Hei-10-204649, for instance).

However, since a treating agent based on zinc phosphate has high concentrations of metal ions and acids and is considerably active, it is economically disadvantageous and low in workability in a wastewater treatment. Further, there is a problem of formation and precipitation of salts, being insoluble in water, associated with the metal surface treatment using the treating agent based on zinc phosphate. Such a precipitated substance is generally referred to as sludge, and increase in cost for removal and disposal of such sludge become problems. In addition, since phosphate ions have a possibility of placing a burden on the environment due to eutrophication, it takes efforts for treating wastewater; therefore, it is preferably not used. Further, there is also a problem that in a metal surface treatment using the treating agent based on zinc phosphate, a surface conditioning is required; therefore, a treatment process become long.

As a metal surface treating agent other than such a treating agent based on zinc phosphate or a chemical conversion coating agent of chromate, there is known a metal surface treating agent comprising a zirconium compound (cf. Japanese Kokai Publication Hei-07-310189, for instance). Such a metal surface treating agent comprising a zirconium compound has an excellent property in point of suppressing the generation of the sludge in comparison with the treating agent based on zinc phosphate described above.

However, a chemical conversion coat attained by the metal surface treating agent comprising a zirconium compound is poor in the adhesion to coating films attained by cationic electrocoating in particular, and usually less used as a pretreatment for cationic electrocoating. In such the metal surface treating agent comprising a zirconium compound, efforts to improve the adhesion and the corrosion resistance by using it in conjunction with another component such as phosphate ions are being made. However, when it is used in conjunction with the phosphate ions, a problem of the eutrophication will arise as described above. In addition, there has been no study on using such treatment using a metal surface treating agent as a pretreatment method for various coatings such as cationic electrocoating. Further, there was a problem that when an iron material was treated with such the metal surface treating agent, the adequate adhesion to a coating film and the corrosion resistance after coating could not be attained.

Further, surface treatment of all metals have to be performed by one step of treatment to articles including various metal materials such as iron, zinc and aluminum for bodies and parts of automobiles in some cases. Accordingly there is desired the development of pretreatment method for coating which can apply a chemical conversion treatment without problems even in such a case. Further, there is desired the development of pretreatment method which can apply a chemical conversion treatment without problems as mentioned above, when other coatings using powder coating composition, organic solvent coating composition, and water-borne coating composition besides cationic electrocoating and anionic electrocoating are applied.

SUMMARY OF THE INVENTION

In consideration of the above circumstances, it is an object of the present invention to provide a pretreatment method for coating, which places a less burden on the environment and can apply good chemical conversion treatment to all metals such as iron, zinc and aluminum.

The present invention is directed to a pretreatment method for coating comprising treating a substance to be treated with a chemical conversion coating agent to form a chemical conversion coat, wherein the chemical conversion coating agent comprises at least one kind selected from the group consisting of zirconium, titanium and hafnium and fluorine, the chemical conversion coat has a fluorine concentration of 10% or less on the atom ratio basis, and at least a part of the substance to be treated is an iron material.

Preferably, the chemical conversion coating agent contains at least one kind selected from the group consisting of magnesium, calcium, zinc, a silicon-containing compound and copper in order to set the fluorine concentration of the chemical conversion coat to 10% or less on the atom ratio basis.

Preferably, the chemical conversion coating agent contains at least one kind selected from the group consisting of a water-borne resin containing an isocyanate group and/or a melamine group (i), a mixture of a water-borne resin, a polyisocyanate compound and/or a melamine resin (ii) and a water-soluble resin having a constituent unit expressed by the chemical formula (1):

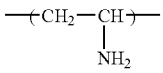

(1)

and/or the chemical formula (2):

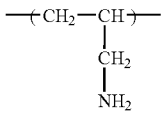

(2)

in at least a part thereof (iii).

Preferably, the chemical conversion coat is heated and dried at a temperature of 30° C. or more after the treatment by the chemical conversion coating agent in order to set the fluorine concentration in the chemical conversion coat to 10% or less on the atom ratio basis.

Preferably, the chemical conversion coat is treated at a temperature from 5 to100° C. with a basic aqueous solution having a pH of 9 or more after the treatment by the chemical conversion coating agent in order to set the fluorine concentration in the chemical conversion coat to 10% or less on the atom ratio basis.

Preferably, the chemical conversion coating agent contains 20 to 10000 ppm of at least one kind selected from the group consisting of zirconium, titanium and hafnium in terms of metal, and has a pH of 1.5 to 6.5.

DETAILED DESCRIPTION OF THE INVENTION

Hereinafter, the present invention will be described in detail.

The present invention provides a method of performing a pretreatment for coating with at least one kind selected from the group consisting of zirconium, titanium and hafnium without substantially using harmful heavy metal ions such as chromium and vanadium and phosphate ions. Usually, it is said that in a metal surface treatment by a Zirconium-containing chemical conversion coating agent, for example, hydroxide or oxide of zirconium is deposited on the surface of the base material because metal ions elutes in the chemical conversion coating agent through a dissolution reaction of the metal and pH at an interface increases. In this process, fluorine is not entirely replaced; therefore, this means that a certain amount of fluorine is contained in the chemical conversion coats. It is considered that since fluorine remains in the chemical conversion coats as described above, when a coating film is formed and the coating film is then exposed to a corrosive environment, a hydroxy group which has been produced is further substituted for fluorine to produce fluorine ions. Consequently, bonds between the coating film and the metal are broken and the adequate adhesion cannot be attained. Such an action is remarkably developed particularly in the case where the material to be treated is iron. Consequently, when the pretreatment for cationic electrocoating is applied to a substance to be treated at least a part of which contains an iron material, using zirconium, a problem that the adhesion to a coating film is reduced arises. Based on these findings, the present invention improves the above-mentioned problems by reducing the fluorine concentration in the chemical conversion coat to 10% or less on the atom ratio basis.

In accordance with the pretreatment method for coating of the present invention, it is possible to treat a substance to be treated at least a part of which contains an iron material and to form a chemical conversion coat which is excellent in the adhesion to a coating film. All of the substance to be treated may be the iron material or a part of that may be an aluminum material and/or a zinc material.

The iron material, the aluminum material and the zinc material mean a material made of iron and/or its alloy, a material made of aluminum and/or its alloy and a material made of zinc and/or its alloy, respectively.

The iron material is not particularly limited, and examples thereof may include a cold-rolled steel sheet, a hot-rolled steel sheet and the like. The aluminum material is not particularly limited, and examples thereof may include 5000 series aluminum alloy, 6000 series aluminum alloy and the like. The zinc material is not particularly limited, and examples thereof may include steel sheets which are plated with zinc or a zinc-based alloy through electroplating, hot dipping and vacuum evaporation coating, such as a galvanized steel sheet, a steel sheet plated with a zinc-nickel alloy, a steel sheet plated with a zinc-iron alloy, a steel sheet plated with a zinc-chromium alloy, a steel sheet plated with a zinc-aluminum alloy, a steel sheet plated with a zinc-titanium alloy, a steel sheet plated with a zinc-magnesium alloy and a steel sheet plated with a zinc-manganese alloy, and the like.

At least one kind selected from the group consisting of zirconium, titanium and hafnium contained in the chemical conversion coating agent used in the pretreatment method for coating of the present invention is a component constituting a chemical conversion coat. By treating the material with the chemical conversion coating agent containing at least one kind selected from the group consisting of zirconium, titanium and hafnium, a chemical conversion coat, which includes at least one kind selected from the group consisting of zirconium, titanium and hafnium, is formed on the material. Thereby, the corrosion resistance and the abrasion resistance of the material are improved and, further, the adhesion to a coating film formed subsequently becomes excellent. A supply source of the zirconium is not particularly limited, and examples thereof include alkaline metal fluoro-zirconate such as $K_2ZrF_6$, fluoro-zirconate such as $(NH_4)_2ZrF6$, soluble fluoro-zirconate like fluoro-zirconate acid such as $H_2ZrF6$, zirconium fluoride, zirconium oxide and the like.

A supply source of the titanium is not particularly limited, and examples thereof include alkaline metal fluoro-titanate, fluoro-titanate such as $(NH_4)_2TiF_6$, soluble fluoro-titanate like fluoro-titanate acid such as $H_2TiF_6$, titanium fluoride, titanium oxide and the like.

A supply source of the hafnium is not particularly limited, and examples thereof include fluoro-hafnate acid such as $H_2HfF_6$, hafnium fluoride and the like.

As a supply source of at least one kind selected from the group consisting of zirconium, titanium and hafnium, a compound having at least one kind selected from the group consisting of $ZrF_6^{2-}$, $TiF_6^{2-}$ and $HfF_6^{-2}$ is preferable because of high ability of forming a coat.

Preferably, the content of at least one kind selected from the group consisting of zirconium, titanium and hafnium, which is contained in the chemical conversion coating agent is within a range from 20 ppm of a lower limit to 10000 ppm of an upper limit in terms of metal. When the content is less than the above lower limit, the performance of the chemical conversion coat to be obtained is inadequate, and when the content exceeds the above upper limit, it is economically disadvantageous because further improvements of the performances cannot be expected. More preferably, the lower limit is 50 ppm and the upper limit is 2000 ppm.

Fluorine contained in the chemical conversion coating agent plays a role as an etchant of a material. A supply source of the fluorine is not particularly limited, and examples thereof include fluorides such as hydrofluoric acid, ammonium fluoride, fluoboric acid, ammonium hydrogenfluoride, sodium fluoride, sodium hydrogenfluoride and the like. In addition, an example of complex fluoride includes hexafluorosilicate, and specific examples thereof include hydrosilicofluoric acid, zinc hydrosilicofluoride, manganesehydrosilicofluoride, magnesium hydrosilicofluoride, nickel hydrosilicofluoride, iron hydrosilicofluoride, calcium hydrosilicofluoride and the like.

Preferably, the chemical conversion coating agent substantially contains no phosphate ions. Substantially containing no phosphate ions means that phosphate ions are not contained to such an extent that the phosphate ions act as a component in the chemical conversion coating agent. Since the chemical conversion coating agent substantially contains no phosphate ions, phosphorus causing a burden on the environment is not substantially used and the formation of the sludge such as iron phosphate and zinc phosphate, formed in the case of using a treating agent based on zinc phosphate, can be suppressed.

In the chemical conversion coating agent, preferably, a pH is within a range from 1.5 of a lower limit to 6.5 of an upper limit. When the pH is less than 1.5, etching becomes excessive; therefore, adequate coat formation becomes impossible. When it exceeds 6.5, etching becomes insufficient; therefore, a good coat cannot be attained. More preferably, the above lower limit is 2.0 and the above upper limit is 5.5. Still more preferably, the above lower limit is 2.5 and the above upper limit is 5.0. In order to control the pH of the chemical conversion coating agent, there can be used acidic compounds such as nitric acid and sulfuric acid, and basic compounds such as sodium hydroxide, potassium hydroxide and ammonia.

The pretreatment method for coating of the present invention forms a chemical conversion coat, which is excellent in the adhesion to a coating film, by setting the fluorine concentration in the obtained chemical conversion coat to 10% or less on the atom ratio basis. Preferably, the fluorine concentration is 8.0% or less on the atom ratio basis.

The fluorine concentration is determined by analyzing elements contained in the chemical conversion coat using an X-ray photoelectron spectroscopy (AXIS-HS manufactured by Shimadzu Co., Ltd.) and calculating areas of peak intensity of spectroscopy.

The method of setting the fluorine concentration in a chemical conversion coat to 10% or less on the atom ratio basis is not particularly limited, and examples thereof may include the following methods:

(1) a method of further blending at least one kind selected from the group consisting of magnesium, calcium, a silicon-containing compound, zinc and copper in the chemical conversion coating agent;

(2) a method of heating and drying the chemical conversion coat at a temperature of 30° C. or more; and (3) a method of treating the chemical conversion coat at a temperature from 5° C. to 100° C. with a basic aqueous solution having a pH of 9 or more.

The methods (1) to (3) are executed in order to set the fluorine concentration in the chemical conversion coat to 10% or lesson the atom ratio basis. As long as this object is achieved, two or more of the above-mentioned methods may be used in combination.

It is estimated that in the method (1), the dissociation of fluorine and at least one kind selected from the group consisting of zirconium, titanium and hafnium in the chemical conversion coating agent is promoted by blending at least one kind selected from the group consisting of magnesium, calcium, a silicon-containing compound, zinc and copper in the chemical conversion coating agent; therefore, the concentration of fluorine present in the chemical conversion coat is reduced.

The magnesium, calcium, zinc and copper are blended in the chemical conversion coating agent as metal ions. Ions of the above metals can be blended by using nitrate compounds, sulfate compounds and fluorides as supply sources, respectively. Among them, it is preferable to use nitrate compounds as supply sources not to have a detrimental effect on the chemical conversion reaction. The magnesium, calcium, zinc or copper is preferably blended in the chemical conversion coating agent within a range from 0.01 times of a lower limit to 50 times of an upper limit by mass relative to the content of at least one kind selected from the group consisting of zirconium, titanium and hafnium. More preferably, the above-mentioned lower limit is 0.1 times and the above-mentioned upper limit is 10 times.

More-preferably, metal compounds used in the method (1) are zinc compounds or copper compounds. Further, two or more kinds of the above compounds are preferably used in combination. Examples of the preferred combination may include the combination of zinc and magnesium, and the like.

The silicon-containing compound is not particularly limited, and examples there of may include silica, water-soluble silicate compounds, esters of silicic acid, alkyl silicates, silane coupling agents and the like. Among them, silica is preferable and water-dispersed silica is more preferable because it has high dispersibility in the chemical conversion coating agent. The water-dispersed silica is not particularly limited, and examples thereof include spherical silica, chain silica and aluminum-modified silica and the like, which have fewer impurities such as sodium. The spherical silica is not particularly limited, and examples there of may include colloidal silica such as "SNOWTEX N", "SNOWTEX O", "SNOWTEX OXS", "SNOWTEX UP", "SNOWTEX XS", "SNOWTEX AK", "SNOWTEX OUP", "SNOWTEX C" and "SNOWTEX OL" (each manufactured by Nissan Chemical Industries Co., Ltd.), fumed silica such as "AEROSIL" (manufactured by Nippon Aerosil Co., Ltd.), and the like. The chain silica is not particularly limited, and examples thereof may include silica sol such as "SNOWTEX PS-M", "SNOWTEX PS-MO" and "SNOWTEX PS-SO" (each manufactured by Nissan Chemical Industries Co., Ltd.), and the like. Examples of the aluminum-modified silica may include commercially available silica sol such as "ADELITE AT-20A" (manufactured by Asahi Denka Co., Ltd.), and the like.

The silane coupling agent is not particularly limited and, for example, an amino group-containing silane coupling agent is suitably used. The amino group-containing silane coupling agent is a compound having at least an amino group and having a siloxane linkage in a molecule, and examples thereof may include publicly known silane coupling agents such as N-2(aminoethyl)3-aminopropylmethyldimethoxysilane, N-2(aminoethyl)3-aminopropyltrimethoxysilane, N-2(aminoethyl)3-aminopropyltriethoxysilane, 3-aminopropyltrimethoxysilane, 3-aminopropyltriethoxysilane, 3-triethoxysilyl-N-(1,3-dimethyl-butylidene)propylamine, N-phenyl-3-aminopropyltrimethoxysilane and N,N-bis[3-(trimethoxysilyl)propyl]ethylenediamine. The silane coupling agent may include hydrolysates thereof, polymers thereof, and the like.

Preferably, the silicon-containing compound is blended in the chemical conversion coating agent within a range from 0.01 times of a lower limit to 50 times of an upper limit relative to the content of at least one kind selected from the group consisting of zirconium, titanium and hafnium as a silicon component.

Although the silicon-containing compound may be used alone, more excellent effects can be attained when it is used in combination with at least one compound selected from the group consisting of magnesium, calcium, zinc and copper compounds.

In the pretreatment method for coating, when at least one kind selected from the group consisting of magnesium, calcium, a silicon-containing compound, zinc and copper is blended in the chemical conversion coating agent, at least one kind selected from the group consisting of a water-borne resin containing an isocyanate group and/or a melamine group (i), a mixture of a water-borne resin, a polyisocyanate compound and/or a melamine resin (ii) and a water-soluble resin having a constituent unit expressed by the chemical formula (1):

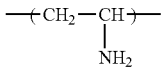

(1)

and/or the chemical formula (2):

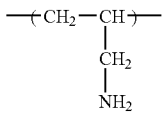

(2)

in at least a part thereof (iii) is preferably blended in the chemical conversion coating agent. It is preferable in point of being able to omit a drying step of chemical conversion coat by the improved reducing effect of fluorine concentration due to blending at least one kind selected from the compounds (i)~(iii).

In the case where the water-borne resin containing an isocyanate group and/or a melamine group (i) is blended, a cured film can be formed because crosslinking is occurred by the isocyanate group and/or a melamine group contained in the water-borne resin.

The water-borne resin is not particularly limited as long as it has the solubility of a level to which it can dissolve a required amount in a chemical conversion coating agent, and a resin including an epoxy resin as a skeleton may be used. The epoxy resin is not particularly limited, and examples thereof include bisphenol A type epoxy resin, bisphenol F type epoxy resin, hydrogenated bisphenol A type epoxy resin, hydrogenated bisphenol F type epoxy resin, bisphenol A propyleneoxide addition type epoxy resin, bisphenol F propyleneoxide addition type epoxy resin, novolac type epoxy resin and the like. Among them, bisphenol F type epoxy resin is preferable and bisphenol F epichlorohydrin type epoxy resin is more preferable.

The isocyanate group may be introduced in the water-borne resin, for example, by reacting a half-blocked diisocyanate compound blocked with a blocking agent with the water-borne resin.

The half-blocked diisocyanate compound may be obtained by reacting a diisocyanate compound with a blocking agent in such a rate that the isocyanate group is excessive. Synthesis of the half-blocked diisocyanate compound and a reaction of the half-blocked diisocyanate compound and the water-borne resin are not particularly limited and may be performed by publicly known methods.

A method of introducing the melamine group in the water-borne resin is not particularly limited, and examples thereof include a method wherein the after-mentioned melamine resin is added to a bisphenol A type epoxy resin or a bisphenol F type epoxy resin and the mixture is stirred at 80° C. for 2 hours while being heated, and the like.

The mixture of a water-borne resin, a polyisocyanate compound and/or a melamine resin (ii) has curability as the water-borne resin containing an isocyanate group and/or a melamine group (i) has.

The water-borne resin is not particularly limited and may include compounds mentioned above.

The polyisocyanate compound is a compound having two or more isocyanate groups, and a blocked or half-blocked polyisocyanate compound which is blocked with a blocking agent is preferably used in order to stably blend the polyisocyanate compound in the water-borne chemical conversion coating agent.

The melamine resin is not particularly limited, and examples thereof include alkoxymethylmelamine resin having alkoxy groups such as methoxy group, ethoxy group, n-butoxy group and i-butoxy group, and the like. The alkoxymethylmelamine resin is normally obtained by etherizing methylolmelamine resin with monohydric alcohol having 1 to 4 carbon atoms, the methylolmelamine resin being obtained by adding aldehydes such as formaldehyde and paraformaldehyde to melamine or by addition-condensing them. In the present invention, the methyl ether group is suitable.

Specific examples of the melamine resin include CYMEL 303, CYMEL 325, CYMEL 327, CYMEL 350, CYMEL 370, CYMEL 385 (each manufactured by Mitsui Cytec Co., Ltd.), SUMIMAL M40S, SUMIMAL M50S, SUMIMALM100 (each manufactured by Sumitomo Chemical Co., Ltd.), and the like as-a type having a methoxy group (methyl ether type). In addition, specific examples of the melamine resin include UVAN 20SE-60, UVAN 20SE-125, UVAN 20SE-128 (each manufactured by Mitsui Chemicals Co., Ltd.), SUPER BECKAMINE G821, SUPER BECKAMINE J820 (each manufactured by Dainippon Ink and Chemicals Co., Ltd.), MYCOAT 506, MYCOAT 508 (each manufactured Mitsui Cytec Co., Ltd.), and the like as a type having a butoxy group (butyl ether type). Further, examples of a mixed ether type melamine include CYMEL 235, CYMEL 238, CYMEL 254, CYMEL 266, CYMEL 267, CYMEL 285, CYMEL 1141 (each manufactured by Mitsui Cytec Co., Ltd.), NIKALACMX-40, NIKALAC MX-45 (each manufactured by Sanwa Chemical Co., Ltd.), and the like.

A method of producing the water-soluble resin having a constituent unit expressed by the chemical formula (1) and/or the chemical formula (2) in at least a part thereof (iii) is not specifically limited, and it can be produced by a publicly known method.

Preferably, the water-soluble resin (iii) is a polyvinylamine resin, which is a polymer comprising only a constituent unit expressed by the above formula (1), and/or a polyallylamine resin, which is a polymer comprising only a constituent unit expressed by the above formula (2). The polyvinylamine resin and polyallylamine resin are particularly preferable in point of having a high degree of effect of improving the adhesion. The polyvinylamine resin is not specifically limited, and commercially available polyvinylamine resins such as PVAM-0595B (manufactured by Mitsubishi Chemical Co., Ltd.) can be used. The polyallylamine resin is not specifically limited, and, for example, commercially available polyallylamine resins such as PAA-01, PAA-10C, PAA-H-10C and PAA-D-11-HCl (each manufactured by Nitto Boseki Co., Ltd.) can be used. Further, the polyvinylamine resin and the polyallylamine resin may be used in combination.

As the water-soluble resin(iii), within the scope of not impairing the object of the present invention, there can also be used a substance formed by modifying a part of amino groups of the polyvinylamine resin and/or polyallylamine resin by methods of acetylating and the like, a substance formed by neutralizing a part of or all of amino groups of the polyvinylamine resin and/or polyallylamine resin with acid, and a substance formed by crosslinking a part of or all of amino groups of the polyvinylamine resin and/or polyallylamine resin with a crosslinking agent within the scope of not affecting the solubility of the resin.

Preferably, the water-soluble resin (iii) has an amino group having an amount within a range from 0.01 mole of a lower limit to 2.3 moles of an upper limit per 100 g of the resin. When the amount of the amino group is less than 0.01 mole, it is not preferable because the adequate effect cannot be attained. When it exceeds 2.3 moles, there is a possibility that the objective effect cannot be attained. More preferably, the above-mentioned lower limit is 0.1 mole.

Preferably, at least one kind selected from the group consisting of the compounds (i)~(iii) is blended in the chemical conversion coating agent within a range from 0.01 times of a lower limit to 50 times of an upper limit relative to the content of at least one kind selected from the group consisting of zirconium, titanium and hafnium as a concentration of solid matter.

The method (2) is a method of heating and drying the chemical conversion coat at a temperature of 30° C. or more, thereby volatilizing the fluorine contained in the chemical conversion coat and, further, promoting the substitution of a hydroxy group for fluorine combined with at least one kind selected from the group consisting of zirconium, titanium and hafnium, thereby reducing a fluorine ratio. Drying time is not particularly limited and it is sufficient for the surface temperature of the coat to reach an ambient temperature for drying. Although an upper limit of drying temperature is not particularly limited, it is preferred to be 300° C. or less in consideration of workability. The above-mentioned drying temperature is more preferably 40° C. or more. A drier used in the method (2) is not particularly limited as long as it is a drier used usually and examples thereof may include a hot-air drier, an electrical drier and the like. In order to reduce a fluorine amount with efficiency, it is preferred to perform rinsing with water prior to drying with heat after performing the chemical conversion treatment.

The method (3) is a method of treating the chemical conversion coat with a basic aqueous solution, thereby removing fluorine from the chemical conversion coat. The basic aqueous solution is not particularly limited, and examples thereof may include aqueous solutions of sodium hydroxide, potassium hydroxide, lithium hydroxide, and ammonium. Among them, the aqueous solution of ammonium is preferable because of its easy rinsing in the subsequent steps. It is preferred to treat the obtained chemical conversion coat by immersing it in the basic aqueous solution, having a pH of 9 or more and adjusted to a temperature from 5 to 100° C., for 30 to 300 seconds. After the method (3), rinsing is preferably performed in order to remove basic compounds adhering to the surface of the chemical conversion coat.

A chemical conversion treatment of metal using the chemical conversion coating agent is not particularly limited, and this can be performed by bringing the chemical conversion coating agent into contact with a surface of metal in usual treatment conditions. Preferably, a treatment temperature in the above-mentioned chemical conversion treatment is within a range from 20° C. of a lower limit to 70° C. of an upper limit. More preferably, the above-mentioned lower limit is 30° C. and the above-mentioned upper limit is 50° C. Preferably, a treatment time in the chemical conversion treatment is within a range from 5 seconds of a lower limit to 1,200 seconds of an upper limit. More preferably, the above-mentioned lower limit is 30 seconds and the above-mentioned upper limit is 120 seconds. The chemical conversion treatment method is not particularly limited, and examples thereof include an immersion method, a spray coating method, a roller coating method and the like.

Preferably, a coat amount of the chemical conversion coat attained in the pretreatment method for coating of the present invention is from 0.1 $mg/m^2$ of a lower limit to 500 $mg/M^2$ of an upper limit in a total amount of metals contained in the chemical conversion coating agent. When this coat amount is less than 0.1 $mg/M^2$, it is not preferable because a uniform chemical conversion coat cannot be attained. When it exceeds 500 $mg/m^2$, it is economically disadvantageous. More preferably, the above lower limit is 5 $mg/m^2$ and the above upper limit is 200 $mg/M^2$.

In the pretreatment method for coating of the present invention, it is preferable to apply the chemical conversion treatment to the surface of a material degreased and rinsed with water after being degreased and to post rinse after the chemical conversion treatment.

The above degreasing is performed to remove an oil matter or a stain adhered to the surface of the material, and immersion treatment is conducted usually at 30 to 55° C. for about several minutes with a degreasing agent such as phosphate-free and nitrogen-free cleaning liquid for degreasing. It is also possible to perform pre-degreasing before degreasing as required.

The above rinsing with water after degreasing is performed by spraying once or more with a large amount of water for rinsing in order to rinse a degreasing agent after degreasing.

The above postrinsing after the chemical conversion treatment is performed once or more in order to prevent the chemical conversion treatment from adversely affecting to the adhesion and the corrosion resistance after the subsequent various coating applications. In this case, it is proper to perform the final rinsing with pure water. In this postrinsing after the chemical conversion treatment, either spray rinsing or immersion rinsing may be used, and a combination of these rinsing may be adopted.

In addition, since the pretreatment method for coating of the present invention does not need to perform a surface conditioning which is required in a method of treating by using the zinc phosphate-based chemical conversion coating agent, it is possible to perform the chemical conversion treatment of the material in fewer steps.

A coating can be applied to the metal material to be treated by the pretreatment method for coating of the present invention is not particularly limited, and examples thereof may include coatings using a cationic electrodeposition coating composition, organic solvent coating composition, water-borne coating composition, powder coating composition and so on. For example, the cationic electrodeposition coating composition is not perticularly limited, and a conventionally publicly known cationic electrodeposition coating composition comprising aminated epoxy resin, aminated acrylic resin, sulfonated epoxy resin and the like can be applied.

The pretreatment method for coating of the present invention can form the chemical conversion coat, which is high in the stability as a coat and the adhesion to a coating film, even for iron materials for which pretreatment by the conventional chemical conversion coating agents containing zirconium and the like is not suitable by using the chemical conversion coating agent comprising at least one kind selected from the group consisting of zirconium, titanium and hafnium and fluorine and by setting the fluorine concentration contained in the chemical conversion coat to be obtained to 10% or less on the atom ratio basis.

Further, the pretreatment method for coating of the present invention can perform the chemical conversion treatment of the material efficiently since it does not require the steps of the surface conditioning.

In accordance with the present invention, the pretreatment method for coating, which places a less burden on the environment and does not generate sludge, could be attained. It is possible to form the chemical conversion coat, which is high in the stability as a coat and excellent in the adhesion to a coating film even for iron materials, by the pretreatment method for coating of the present invention. In addition, since a good chemical conversion coat is formed without the surface conditioning in the pretreatment method for coating of the present invention, this pretreatment method for coating is also excellent in the workability and the cost.

EXAMPLES

Hereinafter, the present invention will be described in more detail by way of examples, but the present invention is not limited to these examples.

Example 1

A commercially available cold-rolled steel sheet (manufactured by Nippon Testpanel Co., Ltd., 70 mm×150 mm×0.8 mm) was used as a material, and pretreatment of coating was applied to the material in the following conditions.

(1) Pretreatment of Coating

Degreasing treatment: The material was sprayed at 40° C. for 2 minutes with 2% by mass "SURF CLEANER 53" (degreasing agent manufactured by Nippon Paint Co., Ltd.).

Rinsing with water after degreasing: The material was rinsed for 30 seconds with a spray of running water.

Chemical conversion treatment: A chemical conversion coating agent, having the zirconium concentration of 100 ppm and being pH 4, were prepared by using fluorozirconic acid and sodium hydroxide. The prepared chemical conversion coating agent was set to 40° C. and the material was immersed thereinto. Immersion time was 60 seconds and a coat amount at an initial stage of the treatment was 10 $mg/m^2$.

Rinsing after chemical conversion treatment: The material was rinsed for 30 seconds with a spray of running water. Further, the material was rinsed for 30 seconds with a spray of ion-exchanged water.

Drying: The cold-rolled steel sheet after being rinsed was dried at 80° C. for 5 minutes in an electrical dryer. It is noted that the total amount of metals contained in the chemical conversion coating agent (coat amount) and the fluorine concentration, which are contained in the resulting coat, were analyzed by using "AXIS-HS" (an X-ray photoelectron spectroscopy manufactured by Shimadzu Co., Ltd., X-ray source: mono-Al).

(2) Coating

After 1 $m^2$ of the surface of the cold-rolled steel sheet was treated per 1 liter of the chemical conversion coating agent, electrocoating was applied to the surface in such a manner that a dried film thickness was 20 μm using "POWERNIX 110" (a cationic electrodeposition coating composition manufactured by Nippon Paint Co., Ltd.) and, after rinsing with water, the material was heated and baked at 170° C. for 20 minutes and test sheet was prepared.

Example 2

The test sheet was obtained by following the same procedure as that of Example 1 except that a drying condition was changed to 35° C. and 10 minutes.

Example 3

The test sheet was obtained by following the same procedure as that of Example 1 except that a drying condition was changed to 35° C. and 60 minutes.

Example 4

The test sheet was obtained by following the same procedure as that of Example 1 except that a drying condition was changed to 120° C. and 5 minutes.

Example 5

The test sheet was obtained by following the same procedure as that of Example 1 except that a drying condition was changed to 170° C. and 5 minutes.

Example 6

The test sheet was obtained by following the same procedure as that of Example 1 except that a drying condition was changed to 180° C. and 3 minutes.

Comparative Example 1

The test sheet was obtained by following the same procedure as that of Example 1 except that drying was not performed.

Comparative Example 2

The test sheet was obtained by following the same procedure as that of Example 1 except that a drying condition was changed to 25° C. and 10 minutes.

Comparative Example 3

The test sheet was obtained by following the same procedure as that of Example 1 except that the surface conditioning was performed at room temperature for 30 seconds using "SURF FINE 5N-8M" (manufactured by Nippon Paint Co., Ltd.) after rinsing with water after degreasing and by immersing the test sheet at 35° C. for 2 minutes using "SURF DYNE SD-6350" (a zinc phosphate-based chemical conversion coating agent manufactured by Nippon Paint Co., Ltd.), and drying was not performed.

Comparative Example 4

The test sheet was obtained by following the same procedure as that of Comparative Example 3 except that drying was performed at 80° C. for 5 minutes.

Example 7

The test sheet was obtained by following the same procedure as that of Example 1 except that the zirconium concentration was changed to 500 ppm, the zinc concentration was changed to 500 ppm by adding zinc nitrate, and a drying condition was changed to 25° C. and 10 minutes.

Example 8

The test sheet was obtained by following the same procedure as that of Example 1 except that the zirconium concentration was changed to 500 ppm, the zinc concentration was changed to 500 ppm by adding zinc nitrate, the magnesium concentration was changed to 200 ppm by using magnesium nitrate, and a drying condition was changed to 25° C. and 10 minutes.

Example 9

The test sheet was obtained by following the same procedure as that of Example 1 except that the zirconium concentration was changed to 500 ppm, the zinc concentration was changed to 500 ppm by adding zinc nitrate, the silicon concentration was changed to 200 ppm by using silica (AEROSIL 300, manufactured by Nippon Aerosil Co., Ltd.), and a drying condition was changed to 25° C. and 10 minutes.

Example 10

The test sheet was obtained by following the same procedure as that of Example 1 except that the zirconium concentration was changed to 500 ppm, the magnesium concentration was changed to 500 ppm by adding magnesium nitrate, the silicon concentration was changed to 200 ppm by adding silica (SNOWTEX 0, manufactured by Nissan Chemical Industries, Co., Ltd.), and a drying condition was changed to 25° C. and 10 minutes.

Example 11

The test sheet was obtained by following the same procedure as that of Example 1 except that the copper concentration was changed to 5 ppm by adding copper nitrate, and a drying condition was changed to 25° C. and 10 minutes.

Example 12

The test sheet was obtained by following the same procedure as that of Example 1 except that the zirconium concentration was changed to 500 ppm, and the zinc concentration was changed to 500 ppm by adding zinc nitrate.

Example 13

The test sheet was obtained by following the same procedure as that of Example 1 except that KBP-90 (hydrolysate of 3-aminopropyltrimethoxysilane, effective concentration: 32%, manufactured by Shin-Etsu Chemical Co., Ltd.) was used as silane coupling agent A in an amount of 200 ppm.

Production Example 1

To 190 parts by mass of bisphenol F epichlorohydrin type epoxy compound having an epoxy equivalent of 190 was added 30 parts of diethanolamine and 110 parts of cellosolve acetate, and the mixture was reacted at 100° C. for 2 hours to obtain an amino group-containing water-borne epoxy resin of non-volatile content of 70%.

Production Example 2

100 parts of 2,4-toluenediisocyanate precopolymer of trimethylolpropane of NCO of 13.3% and non-volatile content of 75%, 44 parts of nonylphenol, 5 parts of dimethylbenzylamine and 65 parts of cellosolve acetate were mixed, and the mixture was stirred and reacted at 80° C. for 3 hours in an atmosphere of nitrogen to obtain a partially blocked polyisocyanate of non-volatile content of 70% and NCO of 20%.

The amino group-containing water-borne epoxy resin (70 parts) prepared in Production Example land 30 parts of the above partially blocked polyisocyanate were mixed, the mixture was stirred and reacted at 80° C. for 4 hours, and then it was verified by an infrared spectroscopy that absorption of a NCO group disappeared completely. Then, 3 parts of acetic acid was added to the mixture and further the mixture was diluted with ion-exchanged water to obtain a isocyanate group and amino group-containing water-borne resin A, in which non-volatile content was 25% and a pH was 4.1.

Example 14

The test sheet was obtained by following the same procedure as that of Example 1 except that the magnesium concentration was changed to 200 ppm by adding magnesium nitrate, the isocyanate group and amino group-containing water-borne resin A was used in an amount of 300 ppm as a concentration of solid matter, and coating was performed without drying.

Example 15

The test sheet was obtained by following the same procedure as that of Example 1 except that the magnesium concentration was changed to 200 ppm by adding magnesium nitrate, the zinc concentration was changed to 400 ppm by adding zinc nitrate, and KBE-903 (3-aminopropyltriethoxysilane, effective concentration: 100%, manufactured by Shin-Etsu Chemical Co., Ltd.) was used as silane coupling agent B in an amount of 200 ppm.

Example 16

The test sheet was obtained by following the same procedure as that of Example 1 except that after rinsing after the chemical conversion treatment, alkaline treating was performed at 50° C. for 3 minutes using an aqueous solution of ammonium hydroxide of pH 10 and, after rinsing with water again, coating was performed without drying.

Example 17

The test sheet was obtained by following the same procedure as that of Example 1 except that after rinsing after the chemical conversion treatment, alkaline treating was performed at 50° C. for 10 minutes using an aqueous solution of ammonium hydroxide of pH 9 and, after rinsing with water again, coating was performed without drying.

Example 18

The test sheet was obtained by following the same procedure as that of Example 1 except that after rinsing after the chemical conversion treatment, alkaline treating was performed at 40° C. for 3 minutes using an aqueous solution of potassium hydroxide of pH 12 and, after rinsing with water again, coating was performed without drying.

Example 19

The test sheet was obtained by following the same procedure as that of Example 1 except that after rinsing after the chemical conversion treatment, alkaline treating was performed at 40° C. for 3 minutes using an aqueous solution of lithium hydroxide of pH 12 and, after rinsing with water again, coating was performed without drying.

Example 20

The test sheet was obtained by following the same procedure as that of Example 1 except that after rinsing after the chemical conversion treatment, alkaline treating was performed at 50° C. for 5 minutes using an aqueous solution of sodium hydroxide of pH 9 and, after rinsing with water again, coating was performed without drying.

Comparative Example 5

The test sheet was obtained by following the same procedure as that of Example 1 except that after rinsing after the chemical conversion treatment, alkaline treating was performed at 50° C. for 10 minutes using an aqueous solution of ammonium hydroxide of pH 8 and drying was not performed after rinsing with water again.

Evaluation test

<Observation of Sludge>

After 1 $m^2$ of the surface of the material was treated per 1 liter of the chemical conversion coating agent, haze in the chemical conversion coating agent was visually observed.

○: There is not haze

X: There is haze

<Secondary Adhesion Test (SDT)>

Two parallel lines, which have depth reaching the material, were cut in a longitudinal direction on the obtained test sheet and then the test sheet was immersed at 50° C. in 5% aqueous solution of NaCl. Immersion times were 96 hours for the test sheets obtained in Examples 1 to 6, 480 hours for the test sheets obtained in Examples 7 to 15, 120 hours for the test sheets obtained in Examples 16 to 20, 96 hours for the test sheets obtained in Comparative Examples 1 to 4, and 120 hours for the test sheet obtained in Comparative Example 5. After immersion, a cut portion was peeled off with an adhesive tape and peeling of a coating was observed.

◎: No peeled

○: Slightly peeled

X: Peeled 3 mm or more in width

TABLE 1

| | Chemical conversion treatment | Coat amount ($mg/m^2$) | Drying condition | Fluorine concentration (in a chemical conversion coat at %) | Sludge | SDT |
|---|---|---|---|---|---|---|
| Ex. 1 | Zirconium | 35 | 80° C. × 5 min. | 8.7 | ○ | ○ |
| Ex. 2 | Zirconium | 33 | 35° C. × 10 min. | 9.8 | ○ | ○ |
| Ex. 3 | Zirconium | 31 | 35° C. × 60 min. | 6.7 | ○ | ◎ |
| Ex. 4 | Zirconium | 37 | 120° C. × 5 min. | 7.4 | ○ | ◎ |
| Ex. 5 | Zirconium | 39 | 170° C. × 5 min. | 5.7 | ○ | ◎ |
| Ex. 6 | Zirconium | 36 | 180° C. × 3 min. | 5.7 | ○ | ◎ |
| Compar. Ex. 1 | Zirconium | 33 | Without drying | — | ○ | x |
| Compar. Ex. 2 | Zirconium | 30 | 25° C. × 10 min. | 10.3 | ○ | x |
| Compar. Ex. 3 | Zinc phosphate | — | Without drying | — | x | ◎ |
| Compar. Ex. 4 | Zinc phosphate | — | 80° C. × 5 min. | — | x | ◎ |

TABLE 2

| | Coat amount ($mg/m^2$) | Added element | Additive | Drying condition | Fluorine concentration (in a chemical conversion coat at %) | Sludge | SDT |
|---|---|---|---|---|---|---|---|
| 7 | 35 | Zn | — | 25° C. × 10 min. | 8.8 | ○ | ○ |
| 8 | 49 | Zn, Mg | — | 25° C. × 10 min. | 6.9 | ○ | ◎ |
| 9 | 37 | Zn, Si | — | 25° C. × 10 min. | 7.2 | ○ | ◎ |
| 10 | 51 | Mg, Si | — | 25° C. × 10 min. | 4.8 | ○ | ◎ |
| 11 | 39 | Cu | — | 25° C. × 10 min. | 5.3 | ○ | ◎ |
| 12 | 42 | Zn | — | 80° C. × 5 min. | 6.5 | ○ | ◎ |
| 13 | 38 | Silane coupling agent A | — | — | 4.8 | ○ | ◎ |
| 14 | 43 | Mg | Waterborne resin A | — | 4.5 | ○ | ◎ |
| 15 | 39 | Mg, Zn, Silane coupling agent B | — | — | 4.9 | ○ | ◎ |

TABLE 3

| | Coat amount (mg/m⁻) | Basic aqueous solution | Treatment condition | Fluorine concentration (in a chemical conversion coat at %) | Sludge | SDT |
|---|---|---|---|---|---|---|
| Ex. 16 | 32 | Ammonium hydroxide | pH10 50° C. × 3 min. | 3.1 | ○ | ◎ |
| Ex. 17 | 28 | Ammonium hydroxide | pH9 50° C. × 10 min. | 5.3 | ○ | ◎ |
| Ex. 18 | 35 | Potassium hydroxide | pH12 40° C. × 3 min. | 1.0 | ○ | ◎ |
| Ex. 19 | 36 | Lithium hydroxide | pH12 40° C. × 3 min. | 1.1 | ○ | ◎ |
| Ex. 20 | 33 | Sodium hydroxide | pH9 50° C. × 5 min. | 1.0 | ○ | ◎ |
| Compar. Ex. 5 | 35 | Ammonium hydroxide | pH8 50° C. × 10 min. | 10.5 | ○ | x |

It has been shown from Tables 1, 2 and 3 that the chemical conversion coat formed through the pretreatment method of the present invention has the excellent adhesion to a coating film and there was not the generation of sludge in the chemical conversion coating agent. On the other hand, in Comparative Examples, generation of no sludge in the chemical conversion coating agent and formation of the chemical conversion coat which has excellent adhesion to a coating film could not be attained at once.

The invention claimed is:

1. A pretreatment method for subsequent coating comprising pretreating a surface with a chemical conversion coating agent to form a chemical conversion coat, wherein the chemical conversion coating agent comprises fluorine and at least one member selected from the group consisting of zirconium, titanium and hafnium, the chemical conversion coat has a fluorine concentration of 10% or less on an atom ratio basis of the chemical conversion coat, and at least a part of the surface is an iron material; and wherein the chemical conversion coating agent further contains an amino group-containing-silane coupling agent; and further contains at least one member selected from the group consisting of a water-borne resin containing an isocyanate group or a melamine group or both (i) and a water-soluble resin having a constituent unit expressed by the chemical formula (1):

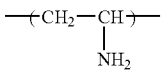

(1)

or the chemical formula (2):

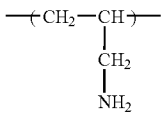

(2)

or both in at least a part thereof (iii); and wherein said chemical conversion coating agent substantially contains no phosphate ions.

2. The pretreatment method for coating according to claim 1, wherein the chemical conversion coating agent contains 20 to 10000 ppm of at least one member selected from the group consisting of zirconium, titanium and hafnium and has a pH of 1.5 to 6.5.

3. The pretreatment method for coating according to claim 1, which further comprises post rinsing after the pretreating.

4. The pretreatment method for coating according to claim 2, which further comprises post rinsing after the pretreating.

5. The pretreatment method for coating according to claim 1, wherein said subsequent coating is a cationic electrocoating.

6. The pretreatment method for coating according to claim 2, wherein said subsequent coating is a cationic electrocoating.

7. A method for coating a surface which comprises pretreating the surface according to the method of claim 1 and then depositing a cationic electrocoating.

8. The method for coating according to claim 7, which further comprises post rinsing after the pretreating and before the cationic electrocoating is deposited.

* * * * *